US008297474B2

(12) United States Patent
Schell

(10) Patent No.: US 8,297,474 B2
(45) Date of Patent: Oct. 30, 2012

(54) CARTRIDGE FOR MULTI-COMPONENT MASSES

(75) Inventor: Andreas Schell, Issing (DE)

(73) Assignee: Hilti Aktiengesellschaft, Schaan (LI)

( * ) Notice: Subject to any disclaimer, the term of this patent is extended or adjusted under 35 U.S.C. 154(b) by 494 days.

(21) Appl. No.: 12/584,778

(22) Filed: Sep. 10, 2009

(65) Prior Publication Data

US 2010/0059547 A1 Mar. 11, 2010

(30) Foreign Application Priority Data

Sep. 11, 2008 (DE) ..... 10 2008 041 984

(51) Int. Cl.
*B67D 7/70* (2010.01)
*B65D 88/54* (2006.01)

(52) U.S. Cl. ..... 222/137; 222/135; 222/145.1; 222/326

(58) Field of Classification Search ..... 222/94, 222/105, 135, 136, 137, 145.1, 326, 386
See application file for complete search history.

(56) References Cited

U.S. PATENT DOCUMENTS

| | | | | |
|---|---|---|---|---|
| 3,333,743 | A * | 8/1967 | Meyers | 222/402.1 |
| 4,691,845 | A * | 9/1987 | Schwartz | 222/94 |
| 4,871,090 | A * | 10/1989 | Hoffmann | 222/81 |
| 4,890,757 | A * | 1/1990 | Robbins, III | 220/675 |
| 5,027,963 | A * | 7/1991 | Robbins, III | 215/395 |
| 5,333,760 | A * | 8/1994 | Simmen | 222/137 |
| 5,443,181 | A * | 8/1995 | Popp et al. | 222/95 |
| 6,129,244 | A | 10/2000 | Horth | |
| 6,457,609 | B1 * | 10/2002 | Keller | 222/137 |
| 2007/0278251 | A1 * | 12/2007 | Guerrera et al. | 222/327 |
| 2009/0057338 | A1 * | 3/2009 | Knee et al. | 222/94 |

FOREIGN PATENT DOCUMENTS

| | | |
|---|---|---|
| DE | 9100054 | 4/1991 |
| WO | WO 89/05189 | 6/1989 |

* cited by examiner

*Primary Examiner* — Kevin P Shaver
*Assistant Examiner* — Nicolas Weiss
(74) *Attorney, Agent, or Firm* — Abelman, Frayne & Schwab

(57) ABSTRACT

A cartridge (21) for multi-component masses has a first receiving member (22) having a receiving space (23) for at least one component (13) of the multi-component mass, and at least one other receiving member (27) extending parallel to the first receiving member (22) and having a receiving space (28) for another component (18) of the multi-component mass, with the receiving space (23) of the first receiving member (22) being larger than the receiving space (28) of the other receiving member (27), and the first receiving member (22) having a lower elasticity, at least in a direction transverse to its longitudinal extent, than the other receiving member (27).

7 Claims, 3 Drawing Sheets

CARTRIDGE FOR MULTI-COMPONENT MASSES

BACKGROUND OF THE INVENTION

1. Field of the Invention

The present invention relates to a cartridge for multi-component masses and including a first receiving member having a receiving space for at least one component of the multi-component mass, and at least one other receiving member which extends parallel to the first receiving member and which has a receiving space for at least one other component of the multi-component mass, with the receiving space of the first receiving member being larger than the receiving space of the at least one other receiving member.

2. Description of the Prior Art

The components of a multi-component mass such as, e.g., a multi-component mortar mass, sealing mass, foam mass, or glue mass, are stored separately from one another until the mass is applied. The components are usually dispensed by a suitable ejection device having a mixing element in which the components are mixed to form a ready-to-use mass. The components of the multi-component mass are provided to the user in a suitable ratio to one another. In the case of a two-component mass, the ratio between the two components may vary between 1:1 and 10:1. Due to the fact that the receiving members of the cartridge are preferably all identically formed, the ratio of the components of the multi-component mass is ensured by corresponding ratios of the cross-sections of the receiving spaces of the receiving members relative to one another. The mixing of the multi-component mass with a correct ratio of the components relative to one another is essential for the quality and, therefore, for the reliable application of the multi-component mass.

For storage and insertion of the multi-component mass in a receptacle of an ejection device, holders having a cartridge, in the receiving spaces of which the components of the multi-component mass are arranged in the appropriate ratio to one another, are used.

The arrangement of the receiving members of a generic cartridge relative to one another is also referred to as a side-by-side arrangement.

In order to reuse such holders or cartridges a number of times, it is known, e.g., from DE 91 00 054 U1 to package the components of the multi-component mass in separate foil pouches or tubular bags. By applying pressure, for example, with pistons that function as ejection means of an ejection device, to the pouch which has advantageously been opened beforehand, the components are dispensed, and the pouch progressively collapses and can subsequently be disposed of separately. These pouches are arranged in the cartridge so that the ejection force acting on the pouches is directed substantially in the ejection direction.

A cartridge of the generic type can be provided to the user as an individual part or as a component part of an ejection device. The components are loaded or inserted into the receiving spaces of the cartridge to be dispensed as a multi-component mass.

Further, International Publication WO 98/44860 A1 discloses a foil container with a cartridge for storing and inserting the multi-component mass in a receptacle of an ejection device. The foil container comprises two foil pouches for each component of the multi-component mass which are secured to a head part with a dispensing opening and enclosed in each instance by a hollow-cylindrical receiving member of the cartridge.

During the forward feed movement of the ejection means, the entire force is not converted into the conveyed volume of the components. A certain proportion of the ejection force is deflected due to the elasticity of the receiving members. At the conclusion of the forward feed, the built-up tension is relieved which in unfavorable cases, leads to an after-flow of the conveyed mass until there is either no pressure remaining in the system or the yield point of the mass or of its components is no longer met.

In a cartridge in which the receiving space of the first receiving member is larger than the receiving space of the at least one other receiving member, the component in the first receiving member is more prone to after-flow. As a result, the required mixing ratio of the components is not ensured and, accordingly, the required chemical reaction no longer takes place with the required stoichiometry or proceeds with a substantially impaired stoichiometry.

In order to avoid this problem, WO 89/05189 suggests dividing each component of the multi-component mass in a cartridge between oppositely arranged receiving members. Therefore, a cartridge of this type for a two-component mass has at least four receiving members arranged parallel to one another for the two components.

The known solution has the drawback that the components can only be dispensed by an ejection device or ejection mechanism that is designed specifically for this construction of the cartridge.

SUMMARY OF THE INVENTION

It is the object of the present invention to provide a cartridge for multi-component masses which makes possible a uniform mixing ratio of the components throughout the entire ejection process and which can be dispensed with conventional ejection devices, e.g., with two piston rods.

This and other objects of the present invention, which will become apparent hereinafter, are achieved by providing a cartridge in which the first receiving member is so designed in relation to the at least one other receiving member that it has a lower elasticity, at least in a direction transverse to its longitudinal extent, than the at least one other receiving member.

The first receiving member is, therefore, stiffer and has a greater rigidity than the at least one other receiving member so that, compared to the at least one other receiving member, it can stretch less in a direction transverse to, i.e., radially or perpendicular to, its longitudinal extent that corresponds to the direction of the application of pressure by the ejection means of the ejection unit. This reduces back the after-flow volume from the first receiving member, and the mixing ratio in the after-flow of the components no longer shifts toward only one component or, if so, then only after a longer period of time. The first receiving member is advantageously formed so that the after-flow behavior of the component dispensed from the first receiving member corresponds to the behavior of the component dispensed from the at least one other receiving member.

In an advantageous manner, at least one material weakness running along the longitudinal extent of the receiving members is provided on the wall of the at least one other receiving member. The material weakness ensures that the first receiving member has a lower elasticity than the at least one other receiving member because the at least one other receiving member deforms more easily under pressure in radial direction to its longitudinal axis.

The material weakness preferably includes a plurality of axial grooves which are formed in the inner wall of the at least one other receiving member and which open toward the receiving space of the at least one other receiving member. The axial grooves can be formed in a simple manner in the at least one other receiving member and ensure an advantageous deformability in radial direction of the at least one other receiving member under pressure. The plurality of axial grooves are advantageously distributed uniformly along the inner circumference of the receiving space of the at least one other receiving member, which ensures a particularly advantageous deformability in radial direction of the at least one other receiving member under pressure.

The wall thickness of the first receiving member is preferably greater than the wall thickness of the at least one other receiving member so that the first receiving member has a lower elasticity than the at least one other receiving member, and the cartridge is easy to produce.

The first receiving member and the at least one other receiving member are preferably made from different materials. The materials are selected from one or more groups of material, e.g., from the group of plastics or metals, so that the at least two receiving members have corresponding elasticity characteristics. For example, the receiving members of the cartridge are made from plastics by injection molding. Polypropylene (PP), for example, is used for the first receiving member with the larger receiving space, and polyethylene (PE) is used for the at least one other receiving member with the smaller receiving space. Further, the entire cartridge can also be made from one material, for example, polyamide (PA), and the variation in material of the receiving members is carried out, for example, by using aromatic or non-aromatic polyamides. Further, at least one of the receiving members can be provided with reinforcements such as, e.g., metal mesh or glass fibers, in order to achieve the desired elasticity characteristics of the receiving members relative to one another.

In an alternative embodiment, the receiving members are produced, for example, from metals or metal hybrids so that the receiving members have correspondingly different elasticity characteristics. In another construction, the first receiving member, for example, is made of metal and the at least one other receiving member is made from a plastic material. In all of the embodiments mentioned above, the receiving members can be connected to one another or are connected to one another when the cartridge is produced.

The material of the first receiving member preferably has a higher modulus of elasticity than the material of the at least one other receiving member so that the first receiving member has a lower elasticity than the at least one other receiving member, and the cartridge is easy to produce.

Reinforcement elements are preferably provided at the first receiving member so as to project from its outer side, so that the first receiving member has a lower elasticity than the at least one other receiving member and the cartridge is easy to produce.

The reinforcement elements preferably are formed as ribs which can be formed in a simple manner with the first receiving member, particularly by casting or injection-molding.

The reinforcement elements are preferably provided along the entire longitudinal extent of the first receiving member. The reinforcement elements advantageously extend along the entire longitudinal extent of the first receiving member. Further, a plurality of reinforcement elements are advantageously arranged so as to be uniformly distributed along the circumference at the outer side of the first receiving member.

The reinforcement elements are preferably provided transverse to the longitudinal extent of the first receiving member so as to extend radially along the circumference. The reinforcement elements advantageously extend over the entire circumference of the first receiving member. Further, a plurality of reinforcement elements are advantageously arranged at a distance from one another along the longitudinal extent of the first receiving member so as to be distributed uniformly at its outer side.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show.

Identical parts are provided with identical reference numerals in the drawings.

DETAILED DESCRIPTION OF THE PREFERRED EMBODIMENTS

Figure 1:
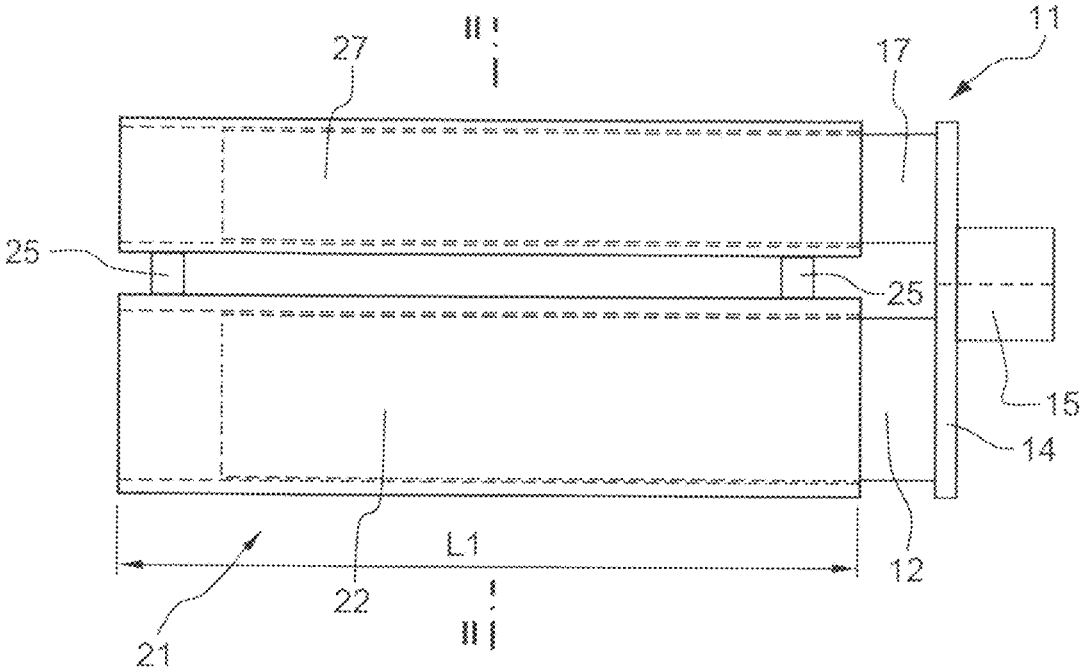
FIG. 1 a plan view of a first embodiment of a foil container with a cartridge according to the present invention.
Figure 2:
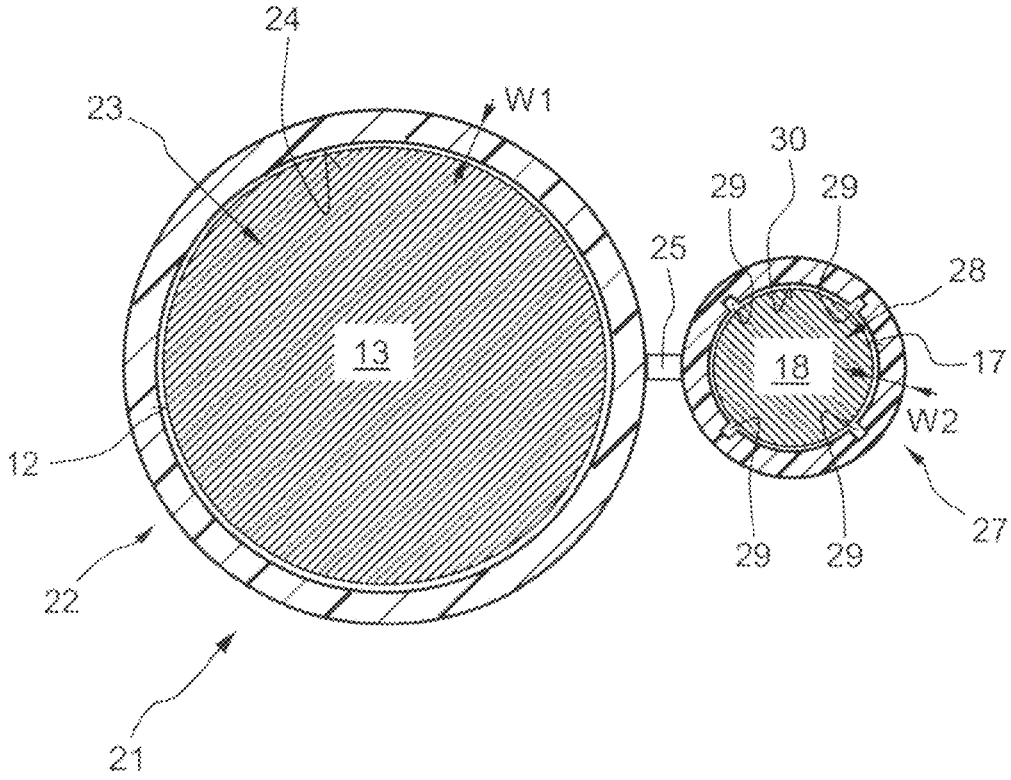
FIG. 2 a cross-sectional view along line II-II in FIG. 1 at an increased, in comparison with FIG. 1, scale.

For a two-component mass, the foil container 11, which is shown in FIGS. 1 and 2, includes a cartridge 21 and two foil pouches 12 and 17 which are secured to a head part 14 with an outlet union 15 for components 13 and 18 of the two-component mass which are packaged in the foil pouches 12 and 17. The foil pouches 12 and 17 are inserted into the cartridge 21 before the start of the ejection process for dispensing the components 13 and 18.

The cartridge 21 can also be provided to the user as a separate part or as a component part of an ejection device for dispensing the components 13 and 18 of the multi-component mass.

The cartridge 21 has a first hollow-cylindrical receiving member 22 having a receiving space 23 with a substantially circular cross-section for a resin as component 13 of the multi-component mass and another, second hollow-cylindrical receiving member 27 having a receiving space 28 with a substantially circular cross-section for a hardener as component 18 of the multi-component mass. The second receiving member 27 is arranged parallel to the first receiving member 22 and has the same longitudinal extent L1 as the first receiving member 22. The first receiving member 22 has a wall thickness W1 which substantially corresponds to the wall thickness W2 of the second receiving member 27.

The components 13 and 18 have a ratio to one another of 3:1. The receiving space 23 of the first receiving member 22 is larger than the receiving space 28 of the other receiving member 27. In accordance with the ratio of the components 13 and 18 to one another, the cross-sectional area of the receiving space 23 corresponds to three times the cross-sectional area of the receiving space 28 of the second receiving member 27.

The foil pouches 12 and 17 are adapted to the cartridge 21 so that the foil pouches 12 and 17 have only a small annular gap relative to the inner wall 24 and 30, respectively, of the corresponding receiving space 23 and 27, respectively, of the cartridge 21 in the inserted state.

The first receiving member 22 is connected to the second receiving member 27 by connection webs 25 for the one-piece cartridge 21. The cartridge 21 is produced from a plastic material by an injection-molding process.

The first receiving member 22 is so formed in relation to the second receiving member 27 that it has a lower elasticity than the second receiving member 27. To this end, a plurality of material weaknesses extends along the longitudinal extent of the second receiving member 27. The material weaknesses are formed as axial grooves 29 which are formed in the inner wall 30 of the second receiving member 27 and are open toward its receiving space 28.

Figure 3:
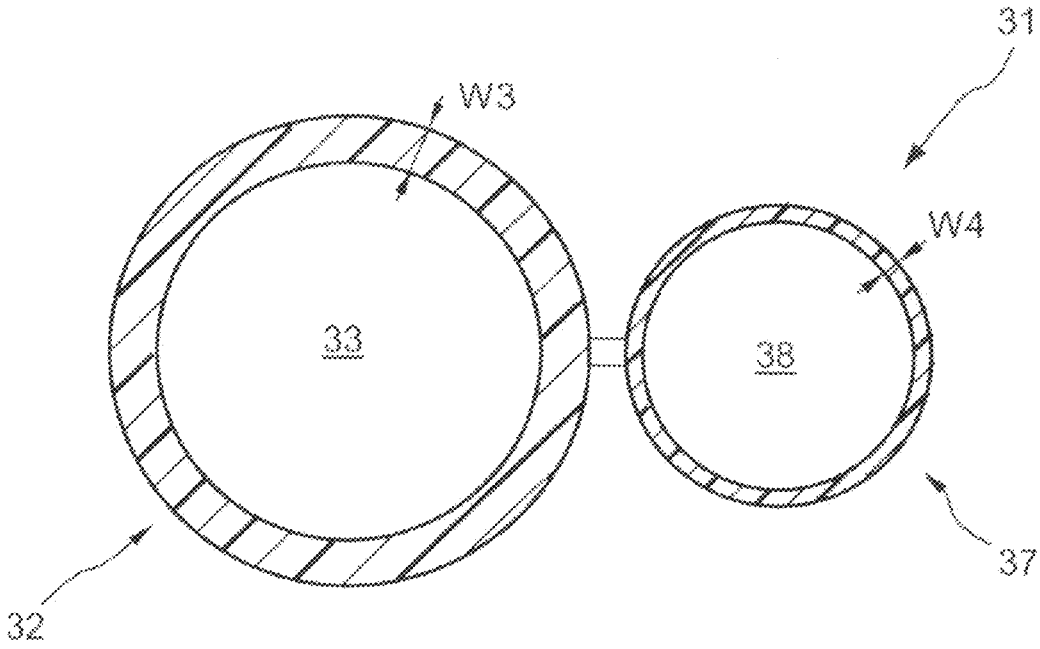
FIG. 3 a cross-sectional view analogous to FIG. 2 of a second embodiment of a cartridge according to the present invention.

In the second embodiment of a cartridge 31 for multi-component masses, as is shown in FIG. 3, this cartridge 31 also has a first receiving member 32 with a receiving space 33 and a second receiving member 37 with a receiving space 38. The first receiving member 32 has a wall thickness W3 which, in this example, is twice the size of the wall thickness W4 of the other receiving member 37. Because of this step, the first receiving member 32 has a lower elasticity than the second receiving member 37.

Figure 4:
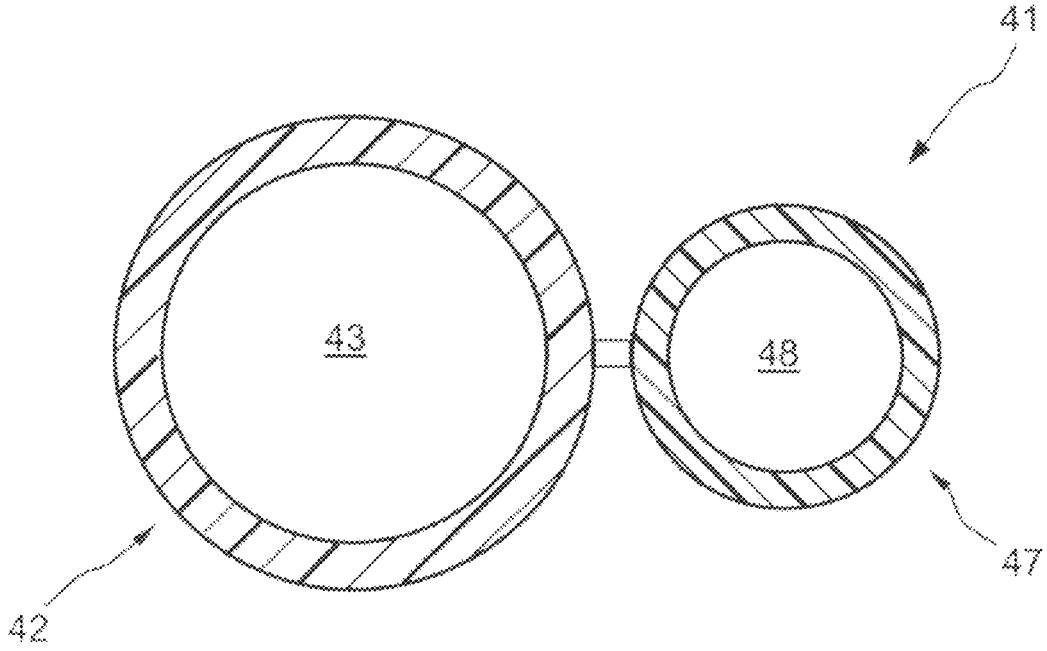
FIG. 4 a cross-sectional view analogous to FIG. 2 of a third embodiment of a cartridge according to the present invention.

FIG. 4 shows a third embodiment of a cartridge 41 for multi-component masses which has a first receiving member 42 with a receiving space 43 and a second receiving member 47 with a receiving space 48. In this embodiment, the cartridge 41 is made from polyamide (PA), and only the first receiving member 42 is reinforced by glass fibers. As a result of this step, the first receiving member 42 has a lower elasticity than the second receiving member 47.

Figure 5:
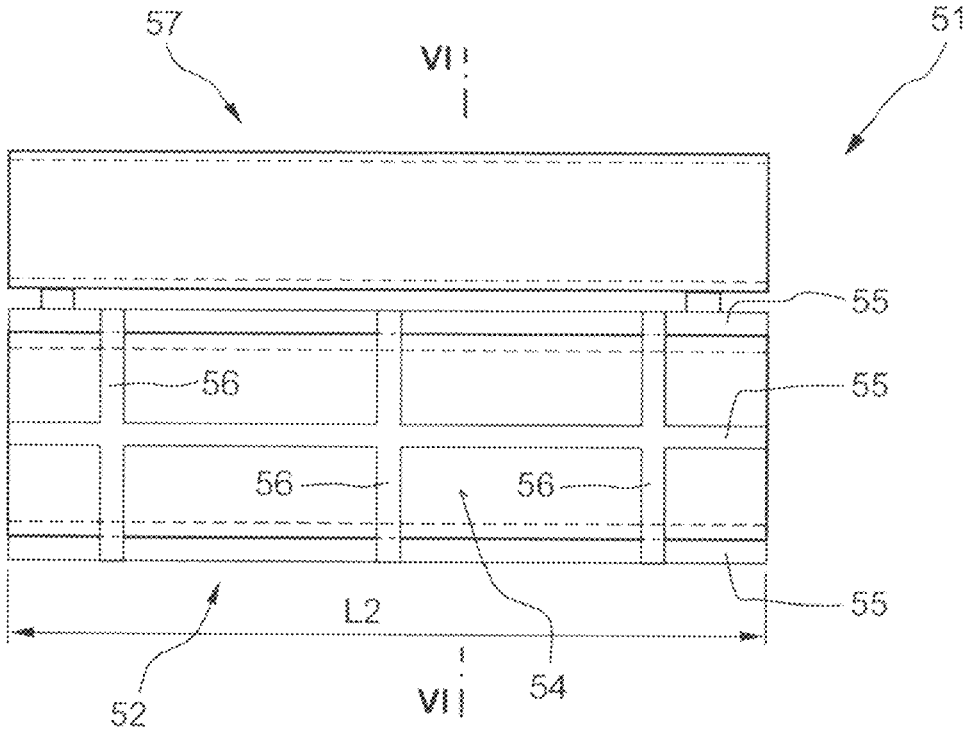
FIG. 5 a plan view of a fourth embodiment of a cartridge according to the present invention.
Figure 6:
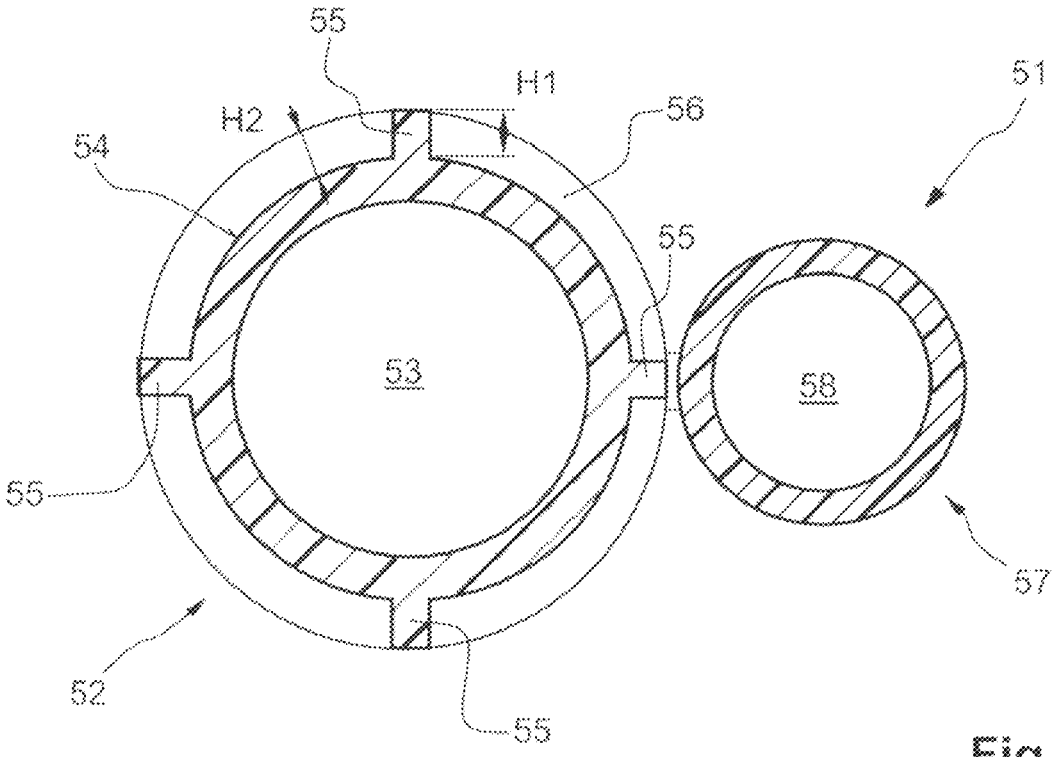
FIG. 6 a cross-sectional view along line VI-VI in FIG. 5 at an increased, in comparison with FIG. 5, scale.

FIGS. 5 and 6 show a fourth embodiment of a cartridge 51 for multi-component masses which has a first receiving member 52 with a receiving space 53 and a second receiving member 57 with a receiving space 58. A plurality of reinforcement elements 55 and 56 formed as ribs project from the outer side 54 of the first receiving member 52. The reinforcement elements 55 extend along the entire longitudinal extent L2 of the first receiving member 52. The reinforcement elements 56 extend transverse to the longitudinal extent L2 of the first receiving member 52 radially around its entire circumference. In this embodiment, the height H1 of the reinforcement elements 55 above the outer side 54 of the first receiving member 52 corresponds to the height H2 of the reinforcement elements 56 above the outer side 54 of the first receiving member 52. Further, all of the reinforcement elements 55 and all of the reinforcement elements 56 in this embodiment are formed substantially identically with respect to their cross-section, which ensures a homogeneous stiffening of the first receiving member 52.

The different steps which are described individually in the discussed embodiments and which result in a lower elasticity of the first receiving member 22, 32, 42 or 52 compared to the second receiving member 27, 37, 47 or 57 can also be combined in one cartridge in order to adapt the elasticity of the first receiving member in a corresponding manner. Accordingly, all or some of the steps described above can be implemented in a cartridge.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A cartridge for multi-component masses, comprising a first receiving member (22; 32; 42; 52) having a receiving space (23; 33; 43; 53) for at least one component (13) of a multi-component mass, and at least one other receiving member (27; 37; 47; 57) arranged parallel to the first receiving member (22; 32; 42; 52) and having a receiving space (28; 38; 48; 58) for at least one other component (18) of the multi-component mass, wherein the receiving space (23; 33; 43; 53) of the first receiving member (22; 32; 42; 52) is larger than the receiving space (28; 38; 48; 58) of the at least one other receiving member (27; 37; 47; 57), and wherein the first receiving member (22; 32; 42; 52) has a lower elasticity, at least in a direction transverse to a longitudinal extent (L1; L2) thereof, than the at least one other receiving member (27; 37; 47; 57), wherein a wall of the at least one other receiving member (27) has at least one material weakness running along the longitudinal extent (L1) of the first receiving member (22), and wherein the material weakness comprises a plurality of axial grooves (29) formed in an inner wall (30) of the at least one other receiving member (27) and which open toward the receiving space (28) of the at least one other receiving member (27).

2. A cartridge for multi-component masses for use with a conventional ejection device having at least two rods, the cartridge comprising a first receiving member (22; 32; 42; 52) having a receiving space (23; 33; 43; 53) for at least one component (13) of a multi-component mass, and at least one other receiving member (27; 37; 47; 57) arranged parallel to and in a spaced relationship with the first receiving member (22; 32; 42; 52), and having a receiving space (28; 38; 48; 58) for at least one other component (18) of the multi-component mass, wherein the first and second receiving members have a substantially same longitudinal extent (L1), wherein the receiving space (23; 33; 43; 53) of the first receiving member (22; 32; 42; 52) is larger than the receiving space (28; 38; 48; 58) of the at least one other receiving member (27; 37; 47; 57), and wherein the first receiving member (22; 32; 42; 52) has a lower elasticity, at least in a direction transverse to a longitudinal extent (L1; L2) thereof, than the at least one other receiving member (27; 37; 47; 57).

3. A cartridge according to claim 2, wherein a wall of the at least one other receiving member (27) has at least one material weakness running along the longitudinal extent (L1) of the first receiving member (22).

4. A cartridge according to claim 2, wherein the at least one other receiving members each has a substantially circular cross-section, and wherein a ratio of the cross-sectional area of the receiving space of the first receiving member and of a cross-sectional area of the receiving space of the at least one other receiving member is three to one.

5. A cartridge according to claim 2, wherein the first receiving member (32) has a wall thickness (W3) which is greater than a wall thickness (W4) of the at least one other receiving member (37).

6. A cartridge according to claim 2, wherein the first receiving member (42) and the at least one other receiving member (47) are formed of different materials.

7. A cartridge according to claim 2, wherein a material of the first receiving member (42) has a higher modulus of elasticity than a material of the at least one other receiving member (47).

* * * * *